US010483652B2

(12) United States Patent
Park et al.

(10) Patent No.: US 10,483,652 B2
(45) Date of Patent: Nov. 19, 2019

(54) MULTI-BEAM ANTENNA AND MULTI-BEAM ANTENNA ARRAY SYSTEM INCLUDING THE SAME

(71) Applicant: AJOU UNIVERSITY INDUSTRY-ACADEMIC COOPERATION FOUNDATION, Suwon-si, Gyeonggi-do (KR)

(72) Inventors: Ikmo Park, Yongin-si (KR); Tran Huy Hung, Suwon-si (KR)

(73) Assignee: AJOU UNIVERSITY INDUSTRY-ACADEMIC COOPERATION FOUNDATION, Suwon-si (KR)

( * ) Notice: Subject to any disclaimer, the term of this patent is extended or adjusted under 35 U.S.C. 154(b) by 233 days.

(21) Appl. No.: 15/496,555

(22) Filed: Apr. 25, 2017

(65) Prior Publication Data

US 2017/0317426 A1 Nov. 2, 2017

(30) Foreign Application Priority Data

May 2, 2016 (KR) ..... 10-2016-0054267

(51) Int. Cl.

| | |
|---|---|
| ***H01Q 21/00*** | (2006.01) |
| ***H01Q 1/48*** | (2006.01) |
| ***H01Q 21/06*** | (2006.01) |
| ***H01Q 9/28*** | (2006.01) |
| ***H01Q 19/10*** | (2006.01) |

(Continued)

(52) U.S. Cl.

CPC ..... *H01Q 21/0006* (2013.01); *H01Q 1/48* (2013.01); *H01Q 9/285* (2013.01); *H01Q 19/108* (2013.01); *H01Q 21/0031* (2013.01); *H01Q 21/065* (2013.01); *H01Q 21/08* (2013.01); *H01Q 21/26* (2013.01)

(58) Field of Classification Search

CPC ..... H01Q 9/0428; H01Q 9/28; H01Q 9/285; H01Q 19/108; H01Q 21/0006; H01Q 21/0031; H01Q 21/08; H01Q 21/065; H01Q 21/26

See application file for complete search history.

(56) References Cited

U.S. PATENT DOCUMENTS 6,400,332 B1 * 6/2002 Tsai ..... H01Q 9/285 343/700 MS
7,084,830 B1 * 8/2006 Suh ..... H01Q 1/38 343/812

(Continued)

FOREIGN PATENT DOCUMENTS

KR 10-2010-0065120 A 6/2010

*Primary Examiner* — Daniel Munoz
(74) *Attorney, Agent, or Firm* — Stein IP, LLC

(57) ABSTRACT

A multi-beam antenna array system according to an exemplary embodiment of the present disclosure includes: a grounding surface; a plurality of multi-beam antennas which each includes a dielectric substrate and a radiating part formed on the dielectric substrate so as to radiate electromagnetic waves, and is disposed above the grounding surface so as to be spaced apart from each other; and a feed circuit which is formed on a lower portion of the grounding surface, and supplies electric power to the plurality of multi-beam antennas so that the electromagnetic waves are radiated in different directions from the plurality of multi-beam antennas.

6 Claims, 16 Drawing Sheets

(51) Int. Cl.
*H01Q 21/08* (2006.01)
*H01Q 21/26* (2006.01)

(56) References Cited

U.S. PATENT DOCUMENTS

| | | | | |
|---|---|---|---|---|
| 9,954,280 | B1 * | 4/2018 | Judd | H01Q 9/265 |
| 2014/0097990 | A1 * | 4/2014 | Aboush | H01Q 9/0435<br>343/700 MS |

* cited by examiner

MULTI-BEAM ANTENNA AND MULTI-BEAM ANTENNA ARRAY SYSTEM INCLUDING THE SAME

CROSS-REFERENCE TO RELATED APPLICATIONS

This application claims the priority of Korean Patent Application No. 10-2016-0054267 filed on May 2, 2016 in the Korean Intellectual Property Office, the disclosure of which is incorporated herein by reference.

BACKGROUND

Field

Exemplary embodiments of the present disclosure relate to a multi-beam antenna, and more particularly, to a multi-beam antenna and a multi-beam antenna array system including the same.

Description of the Related Art

In general, an antenna is an apparatus which transmits electromagnetic waves into a space or receives electromagnetic waves for the purpose of wireless communication.

Researches are being actively conducted on directional antennas, among the antennas, which are capable of concentrating radiated electric power at a particular direction in a space in respect to applications made recently, such as wireless home networks, intelligent networks, or similar type networks.

Until now, because use of the directional antennas has sometimes been restricted to an application field in which there is no size limitation caused by fixed beams, the directional antennas have been configured by a plurality of complicated and expensive modules.

Therefore, it is necessary to develop an antenna capable of radiating radio waves in expanded directions by more simply improving a radiating structure of the existing antenna and supplementing electric power structure to be supplied to the antenna.

As literature in the related art, there is Korean Patent Application Laid-Open No. 10-2010-0065120 (entitled "Antenna with Shared Feeds and Method of Producing Antenna with Shared Feeds for Generating Multiple Beams", published on Jun. 15, 2010).

SUMMARY

An exemplary embodiment of the present disclosure provides a multi-beam antenna array system capable of radiating electromagnetic waves (linearly polarized waves or circularly polarized waves) in a plurality of directions by adjusting an arrangement of a plurality of multi-beam antennas with an improved structure of an electromagnetic wave radiator and selectively applying electric power to a feed circuit.

Another exemplary embodiment of the present disclosure provides a multi-beam antenna using a plurality of parasitic elements, which is capable of radiating broadband electromagnetic waves by improving a structure of a radiator.

Technical problems of the present disclosure are not limited to the aforementioned technical problem(s), and other technical problems, which are not mentioned above, may be clearly understood by those skilled in the art from the following descriptions.

According to an aspect of the present disclosure, there is provided a multi-beam antenna array system including: a grounding surface; a plurality of multi-beam antennas which each includes a dielectric substrate and a radiating part formed on the dielectric substrate so as to radiate electromagnetic waves, and is disposed above the grounding surface so as to be spaced apart from each other; and a feed circuit which is formed on a lower portion of the grounding surface, and supplies electric power to the plurality of multi-beam antennas so that the electromagnetic waves are radiated in different directions from the plurality of multi-beam antennas.

The feed circuit may include first to fourth feed lines which are formed in quadrants formed by quartering the grounding surface, respectively, and the first to fourth feed lines may have structures symmetrical to one another.

Each of the first to fourth feed lines may include: a first curved portion which has one end connected to a port positioned at one side rim of the grounding surface, is curved several times in different directions, and has a length that increases in a direction toward the curved line at the other end; and a second curved portion which extends from the other end of the first curved portion, and is curved several times in the same direction so that a part of the second curved portion is formed in an opened '⊏' shape.

Each of the first to fourth feed lines may include a bridge line defined as a portion which is connected to another feed line formed in the adjacent quadrant of the grounding surface, and a general line defined as a portion which is not connected to another feed line, and a thickness of the bridge line may be different from a thickness of the general line.

A thickness of the bridge line may be greater than a thickness of the general line.

The bridge lines may be connected to each other through a plurality of share lines formed in a direction intersecting a boundary line of the quadrant, a thickness of each of the plurality of share lines may be different from a thickness of the bridge line and a thickness of the general line, and the thickness of each of the plurality of share lines may be smaller than the thickness of the bridge line and the thickness of the general line.

Ends of the first to fourth feed lines of the feed circuit may be curved in a direction of an upper side of the grounding surface, and the curved portions may be correspondingly connected to the plurality of multi-beam antennas, respectively, such that the feed circuit supplies electric power to the plurality of multi-beam antennas.

The feed circuit may be selectively supplied with electric power from a plurality of electric power ports formed at points that are in contact with a rim of the grounding surface, such that the feed circuit selectively may supply electric power to at least one of the plurality of multi-beam antennas.

According to another aspect of the present disclosure, there is provided a multi-beam antenna including: a dielectric substrate; and a radiating part which includes a first radiating element and a second radiating element formed on the dielectric substrate so as to radiate electromagnetic waves, in which the first radiating element includes a first upper radiating member which is formed on an upper portion of the dielectric substrate at one side based on a first direction of the dielectric substrate, and a first lower radiating member which is formed on a lower portion of the dielectric substrate at the other side based on the first direction of the dielectric substrate, and the second radiating element includes a second upper radiating member which is formed on the upper portion of the dielectric substrate at one side based on a second direction of the dielectric substrate, and a second lower radiating member which is formed on the lower portion of the dielectric substrate at the other side based on the second direction of the dielectric substrate.

The electromagnetic wave may be a linearly polarized wave or a circularly polarized wave.

The multi-beam antenna according to the exemplary embodiment of the present disclosure may further include a plurality of parasitic elements which is disposed on the upper portion of the dielectric substrate between the first radiating element and the second radiating element so as to expand a bandwidth of the electromagnetic wave.

The plurality of parasitic elements may be disposed to be spaced apart from the first radiating element and the second radiating element.

The plurality of parasitic elements may have a structure in which the parasitic elements, which face each other, are symmetrical to each other based on an intersection point where the first radiating element and the second radiating element are orthogonal to each other.

The multi-beam antenna according to the exemplary embodiment of the present disclosure may further include: a connecting part which includes a semi-ring-shaped first connecting portion that connects the first upper radiating member and the second upper radiating member, and a semi-ring-shaped second connecting portion that connects the first lower radiating member and the second lower radiating member; and a power supply line which is connected to a lower portion of the radiating part and supplies electric power to the radiating part.

Other detailed matters of the exemplary embodiment are included in the detailed description and the accompanying drawings.

According to the exemplary embodiment of the present disclosure, it is possible to radiate electromagnetic waves in a plurality of directions by adjusting an arrangement of the plurality of multi-beam antennas with the improved structure of the radiator and selectively applying electric power to the feed circuit.

According to the exemplary embodiment of the present disclosure, it is possible to radiate broadband electromagnetic waves by improving the structure of the radiator.

According to the exemplary embodiment of the present disclosure, the antenna array system is implemented by optimizing the number of a plurality of arranged multi-beam antennas, and as a result, it is possible to induce electromagnetic waves to be radiated in expanded directions, and it is possible to radiate the electromagnetic waves in various directions.

According to the exemplary embodiment of the present disclosure, the feed circuit is selectively supplied with electric power from the plurality of electric power ports by means of various combinations, and as a result, it is possible to enable the plurality of multi-beam antennas to radiate electromagnetic waves having more improved performance in desired directions.

BRIEF DESCRIPTION OF THE DRAWINGS

The above and other aspects, features and other advantages of the present disclosure will be more clearly understood from the following detailed description taken in conjunction with the accompanying drawings, in which.

DETAILED DESCRIPTION OF THE PREFERRED EMBODIMENT

Figure 1:
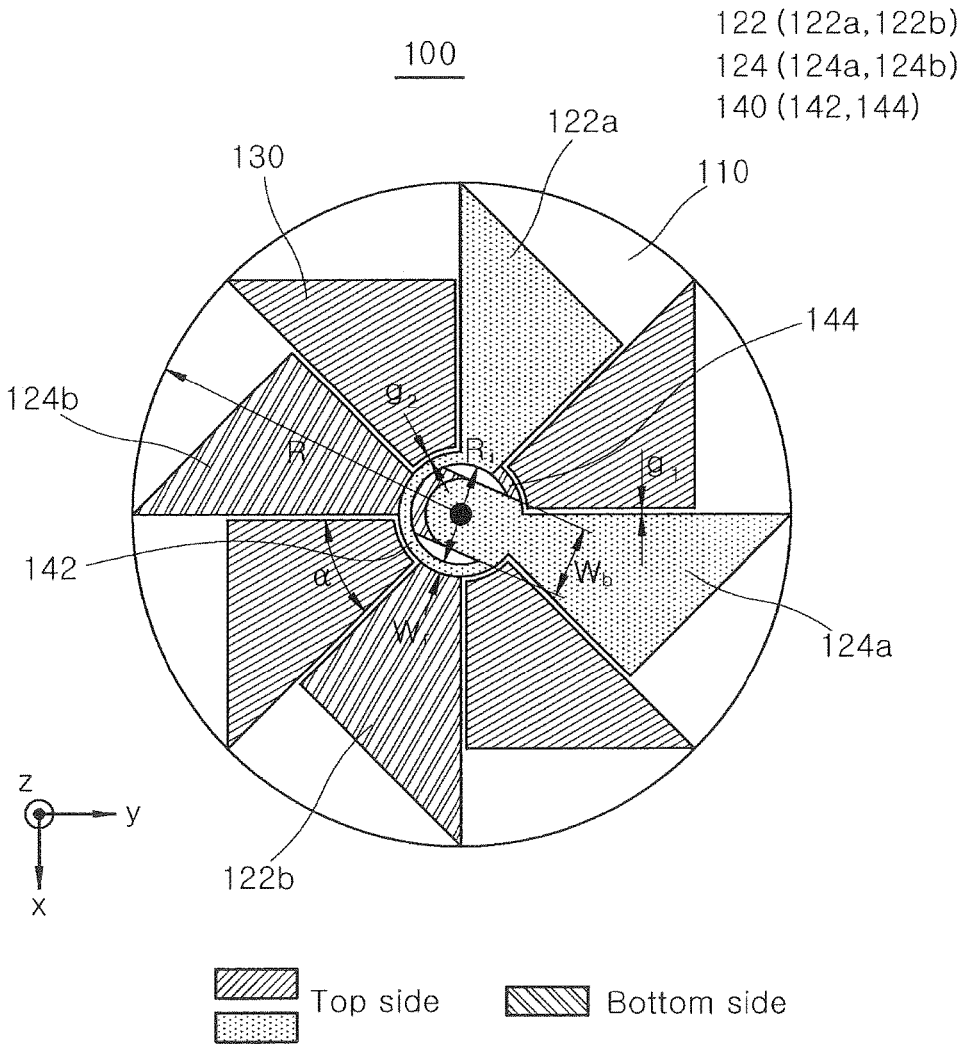
FIG. 1 is a top plan view for explaining a multi-beam antenna according to an exemplary embodiment of the present disclosure.

Advantages and/or features of the present disclosure and methods of achieving the advantages and features will be clear with reference to exemplary embodiments described in detail below together with the accompanying drawings. However, the present disclosure is not limited to the exemplary embodiments set forth below, and may be embodied in various other forms. The present exemplary embodiments are for rendering the disclosure of the present disclosure complete and are set forth to provide a complete understanding of the scope of the disclosure to a person with ordinary skill in the technical field to which the present disclosure pertains, and the present disclosure will only be defined by the scope of the claims. Like reference numerals indicate like constituent elements throughout the specification.

Hereinafter, exemplary embodiments of the present disclosure will be described in detail with reference to the accompanying drawings.

Figure 2:
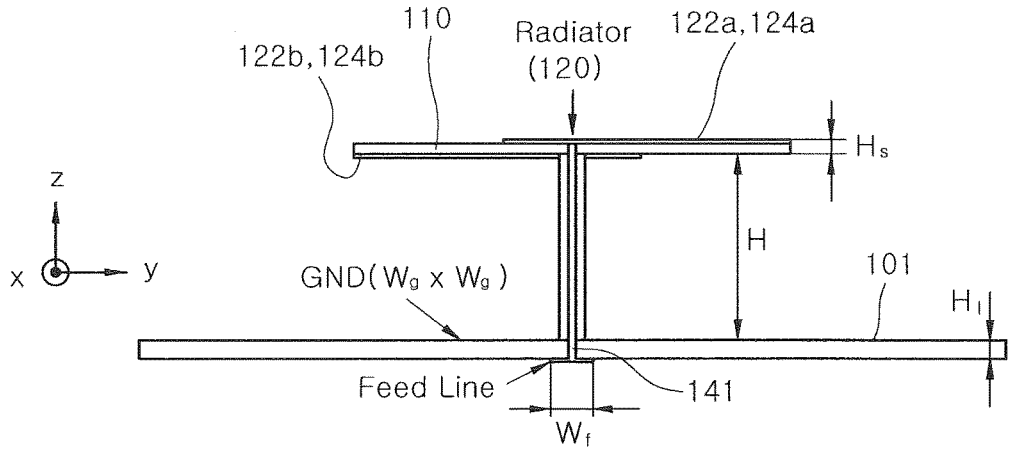
FIG. 2 is a side view for explaining the multi-beam antenna according to the exemplary embodiment of the present disclosure.

FIG. 1 is a top plan view for explaining a multi-beam antenna according to an exemplary embodiment of the present disclosure, and FIG. 2 is a side view for explaining the multi-beam antenna according to the exemplary embodiment of the present disclosure.

Referring to FIGS. 1 and 2, a multi-beam antenna 100 according to an exemplary embodiment of the present disclosure may include a dielectric substrate 110, a radiating part 120, a plurality of parasitic elements 130, and an electromagnetic wave generator 140.

The dielectric substrate 110 may be disposed to be spaced apart from a grounding surface 101 formed below the dielectric substrate 110.

In this case, the dielectric substrate 110 may be formed as a circular substrate, and may have upper and lower flat surfaces having a comparatively large area. For example, the dielectric substrate 110 may be implemented as a substrate having a width of 12.6 mm, a length of 12.6 mm, and a thickness of 0.5 mm.

In the exemplary embodiment of the present disclosure, the dielectric substrate 110 has a circular cross-sectional shape, but the present disclosure is not limited thereto, and the dielectric substrate 110 may be formed in various shapes such as a rectangular shape and a polygonal shape.

The dielectric substrate 110 may be made of a dielectric material having permittivity, and for example, the dielectric substrate 110 may be implemented as a Rogers RO4003 substrate having permittivity of 3.38 and a dielectric loss tangent of 0.0027.

The radiating part 120 may be formed of two different types of dipole radiating elements. That is, the radiating part 120 may include a first radiating element 122 and a second radiating element 124. The first radiating element 122 and the second radiating element 124 may be formed on the dielectric substrate 110 so as to be orthogonal to each other, but the present disclosure is not limited thereto, and the first radiating element 122 and the second radiating element 124 may be formed in various shapes such as a shape in which the first radiating element 122 and the second radiating element 124 intersect each other. Hereinafter, the first radiating element 122 and the second radiating element 124 will be specifically described.

The first radiating element 122 may include a first upper radiating member 122*a* and a first lower radiating member 122*b* which are formed at one side and the other side of the dielectric substrate 110, respectively, based on a first direction of the dielectric substrate 110.

For reference, in the present exemplary embodiment, the first direction may be identical to a direction of an x-axis in FIG. 1.

The first upper radiating member 122*a* may be formed on an upper portion of the dielectric substrate 110 at one side based on the first direction of the dielectric substrate 110, and the first lower radiating member 122*b* may be formed on a lower portion of the dielectric substrate 110 at the other side based on the first direction of the dielectric substrate 110.

Therefore, the first upper radiating member 122*a* and the first lower radiating member 122*b* may be formed on upper and lower surfaces of the first dielectric substrate 110, respectively, and may be symmetrical to each other.

For reference, in the present exemplary embodiment, the first upper radiating member 122*a* and the first lower radiating member 122*b* may be formed at right and left sides of the dielectric substrate 110, respectively, based on the first direction of the dielectric substrate 110.

The second radiating element 124 may include a second upper radiating member 124*a* and a second lower radiating member 124*b* which are formed at one side and the other side of the dielectric substrate 110 based on a second direction of the first dielectric substrate 110. For reference, in the present exemplary embodiment, the second direction may be identical to a direction of a y-axis in FIG. 1.

The second upper radiating member 124*a* may be formed on the upper portion of the dielectric substrate 110 at one side based on the second direction of the dielectric substrate 110, and the second lower radiating member 124*b* may be formed on the lower portion of the dielectric substrate 110 at the other side based on the second direction of the dielectric substrate 110.

Therefore, similar to the first upper radiating member 122*a* and the first lower radiating member 122*b*, the second upper radiating member 124*a* and the second lower radiating member 124*b* may be formed on the upper and lower surfaces of the first dielectric substrate 110, respectively, and may be symmetrical to each other.

For reference, in the present exemplary embodiment, the second upper radiating member 124*a* and the second lower radiating member 124*b* may be formed at upper and lower sides of the dielectric substrate 110, respectively, based on the second direction of the dielectric substrate 110.

Meanwhile, the first radiating element 122 and the second radiating element 124 may be implemented on the upper and lower surfaces of the first dielectric substrate 110 by dry etching, respectively.

The first radiating element 122 and the second radiating element 124 may be connected to each other as triangular elements are disposed to face each other, but otherwise, an overall shape of the first radiating element 122 and the second radiating element 124 may be implemented in a pinwheel shape.

For reference, in the present exemplary embodiment, as illustrated in FIG. 1, each of the first radiating element 122 and the second radiating element 124 is formed as a triangular element, but the present disclosure is not limited thereto, and each of the first radiating element 122 and the second radiating element 124 may be implemented in various shapes such as a quadrangular shape or an elliptical shape.

The connecting part 140 may serve to enable the radiating part 120 to radiate electromagnetic waves. To this end, the connecting part 140 may include a first connecting portion 142 and a second connecting portion 144 which are formed at an intersection point between the first radiating element 122 and the second radiating element 124.

The first connecting portion 142 is disposed on the upper portion of the dielectric substrate 110 so as to connect the first upper radiating member 122*a* and the second upper radiating member 124*a*, and may be formed in a semi-ring shape having a size of a predetermined radius R1 from the intersection point where the first radiating element 122 and the second radiating element 124 are orthogonal to each other.

The second connecting portion 144 is disposed on the lower portion of the dielectric substrate 110 so as to connect the first lower radiating member 122*b* and the second lower radiating member 124*b*, and may be formed in a semi-ring shape having a size of a predetermined radius R1 from the intersection point where the first radiating element 122 and the second radiating element 124 are orthogonal to each other.

In this case, the first and second connecting portions 142 and 144 are formed in a dual ring shape at the intersection point, and the radiating part 120 may radiate electromagnetic waves through the dual ring.

That is, the connecting part 140 generates a phase difference (90 degrees) with respect to radio waves generated at the dual ring by an electrical signal transmitted through a power supply line 141 connected to a lower portion of the radiating part 120, thereby enabling the radiating part 120 to radiate electromagnetic waves.

The plurality of parasitic elements 130 may be formed between the first radiating element 122 and the second radiating element 124.

In other words, the plurality of parasitic elements 130 may be disposed on the upper portion of the dielectric substrate 110 so as to be spaced apart from each other between the first radiating element 122 and the second radiating element 124.

In addition, the plurality of parasitic elements 130 may have a structure in which the parasitic elements 130, which face each other, are symmetrical to each other based on the intersection point where the first radiating element 122 and the second radiating element 124 are orthogonal to each other.

For reference, the plurality of parasitic elements 130 may be implemented on the upper surface of the dielectric substrate 110 by dry etching.

Meanwhile, unlike the present exemplary embodiment, one to three parasitic elements 130, among the plurality of parasitic elements 130, may be formed between the first radiating element 122 and the second radiating element 124, but a total of four parasitic elements 130 may be formed like the present exemplary embodiment in order to radiate electromagnetic waves having a symmetrical structure from the radiating part 120.

Figure 3:
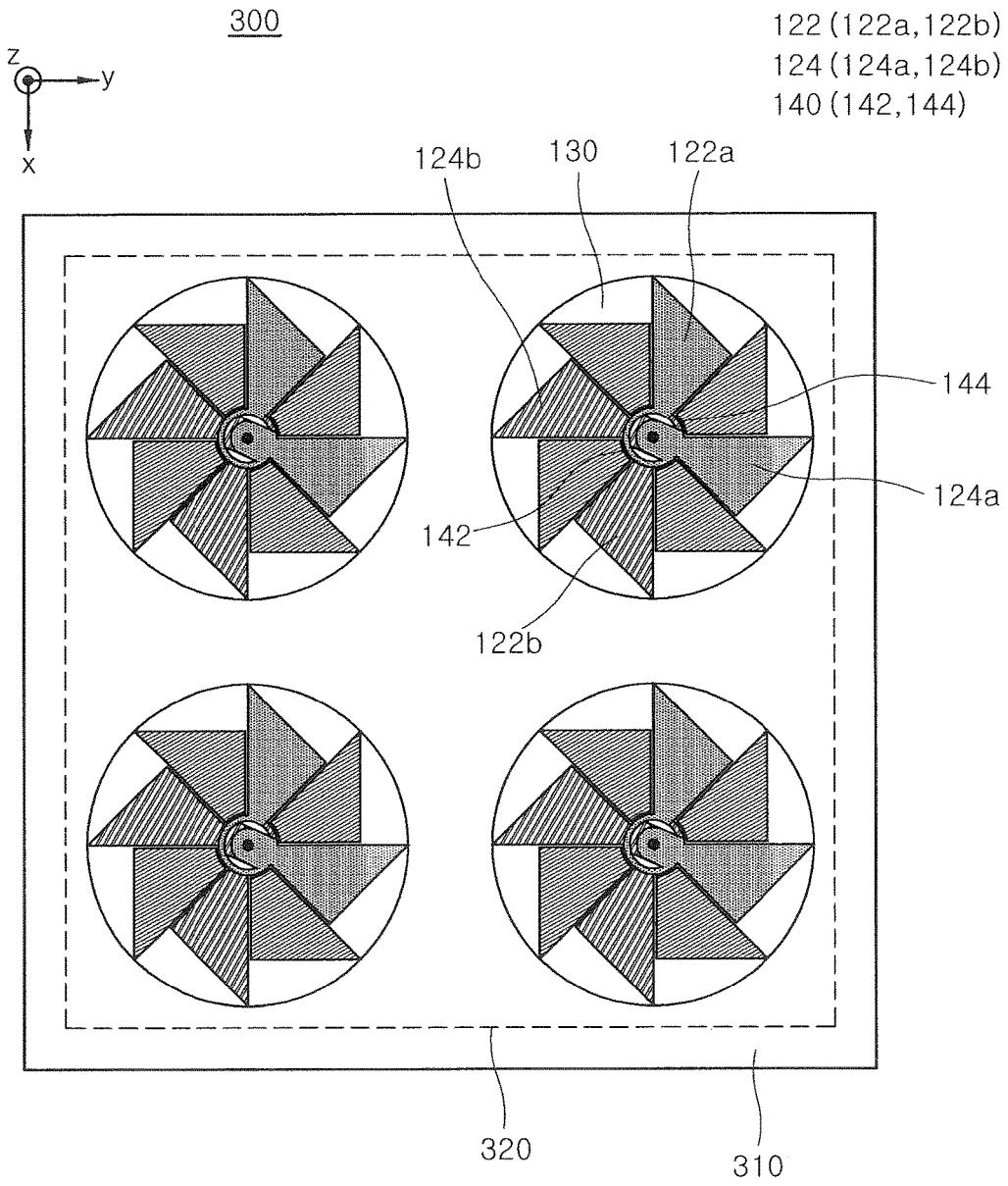
FIG. 3 is a top plan view for explaining a multi-beam antenna array system according to the exemplary embodiment of the present disclosure.
Figure 4:
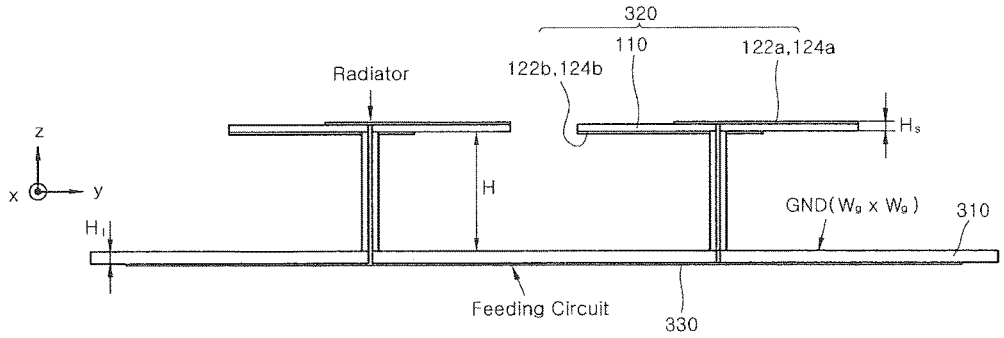
FIG. 4 is a side view for explaining the multi-beam antenna array system according to the exemplary embodiment of the present disclosure.
Figure 5:
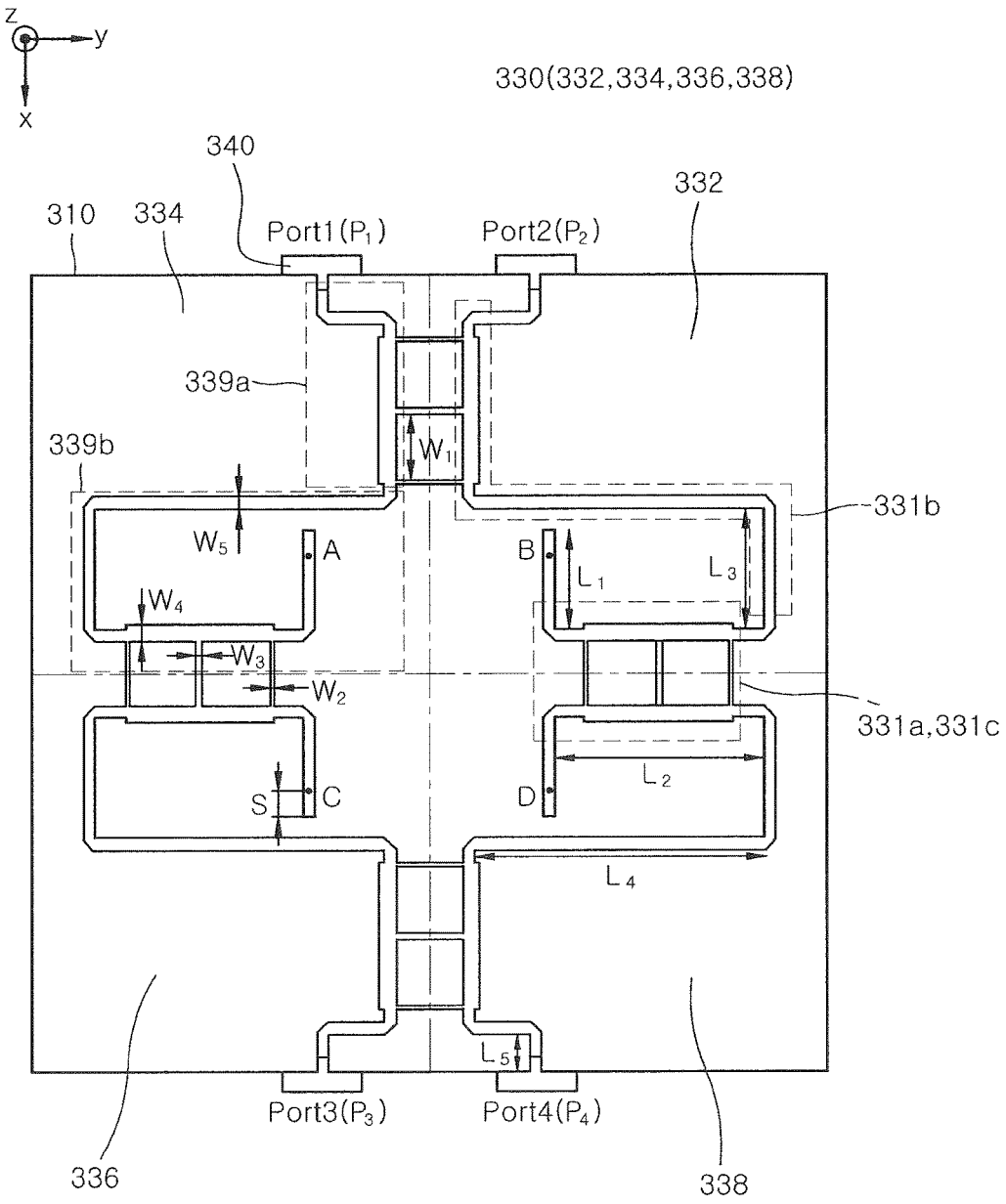
FIG. 5 is a bottom plan view of the multi-beam antenna array system according to the exemplary embodiment of the present disclosure, which is illustrated to explain a feed circuit in FIG. 4.

FIG. 3 is a top plan view for explaining a multi-beam antenna array system according to the exemplary embodiment of the present disclosure, FIG. 4 is a side view for explaining the multi-beam antenna array system according to the exemplary embodiment of the present disclosure, and FIG. 5 is a bottom plan view of the multi-beam antenna array system according to the exemplary embodiment of the present disclosure, which is illustrated to explain a feed circuit 330 in FIG. 4.

Referring to FIGS. 3 to 5, a multi-beam antenna array system 300 according to the exemplary embodiment of the present disclosure includes a grounding surface 310, a plurality of multi-beam antennas 320, and a feed circuit 330.

The grounding surface 310 may have a comparatively large and flat surface, and may have a surface made of a conductive metallic material such as copper, gold, or aluminum so that constant electric current may be applied to the dielectric substrate 110 of the multi-beam antenna 320.

In addition, the grounding surface 310 has a square shape, but the present disclosure is not limited thereto, and the grounding surface 310 may be formed in various shapes such as a circular shape, an elliptical shape, and a polygonal shape.

Among the plurality of multi-beam antennas 320, the plurality of multi-beam antennas 100 in FIG. 1 are arranged on an upper portion of the grounding surface 310 so as to be spaced apart from each other.

In addition, the plurality of multi-beam antennas 320 are disposed on the upper portion of the grounding surface 310 so as to be spaced apart from each other at predetermined intervals, and may radiate electromagnetic waves (linearly polarized waves or circularly polarized waves).

In the present exemplary embodiment, it is possible to change the number of arranged multi-beam antennas 320, and thus it is possible to adjust a radiation range or a radiation direction of the electromagnetic wave in accordance with the number of arranged multi-beam antennas 320.

In other words, the number of arranged multi-beam antennas 320 may be used as a parameter for determining a radiation range or a radiation direction of the electromagnetic wave. For example, as the number of the plurality of arranged multi-beam antennas 320 increases, a radiation range of the electromagnetic wave may be expanded, and a radiation direction may be diversified.

For reference, in the present exemplary embodiment, the plurality of multi-beam antennas 320 is implemented to be arranged in a 2*2 matrix form, but a size of the matrix may vary depending on a size (breadth or width) of the grounding surface 310 or a size of the plurality of multi-beam antennas 320. For example, the plurality of multi-beam antennas 320 may be arranged in a 3*3 or 4*4 matrix form.

Therefore, according to the exemplary embodiment of the present disclosure, the antenna array system 300 is implemented by optimizing the number of the plurality of arranged multi-beam antennas 320, and as a result, it is possible to induce electromagnetic waves to be radiated in expanded directions, and it is possible to radiate the electromagnetic waves in various directions.

The feed circuit 330 is a feed network including feed lines, and the feed circuit 330 is formed on a lower portion of the grounding surface 310.

In this case, the feed circuit 330 may include first to fourth feed lines 332, 334, 336, and 338 which are formed in quadrants formed by quartering the grounding surface 310, respectively.

That is, the feed circuit 330 may be formed such that the first feed line 332 is disposed in a first quadrant of the grounding surface 310, the second feed line 334 is disposed in a second quadrant, the third feed line 336 is disposed in a third quadrant, and the fourth feed line 338 is disposed in a fourth quadrant.

The first to fourth feed lines 332, 334, 336, and 338 may have structures symmetrical to one another, and for example, the first to fourth feed lines 332, 334, 336, and 338 may be symmetrical to one another based on a vertical direction and a horizontal direction of the grounding surface 310 at a center of the feed circuit 330.

In this case, each of the first to fourth feed lines 332, 334, 336, and 338 may be configured as a curved line curved several times, and to this end, each of the first to fourth feed lines 332, 334, 336, and 338 may have a first curved portion 339*a* and a second curved portion 339*b*.

One end of the first curved portion 339*a* is connected to a port 340 positioned at one side rim of the grounding surface 310, and may be curved several times in different directions.

In addition, a length of the first curved portion 339*a* may be increased in a direction toward a curved line at the other end. Therefore, a length of the curved line formed to an (n)th curved point may be shorter than a length of the curved line formed to an (n+1)th curved point.

The second curved portion 339*b* may extend from the other end of the first curved portion 339*a*, and may be curved several times in the same direction.

The second curved portion 339*b* may be curved several times in the same direction, and an angle at which the second curved portion 339*b* is curved is the right angle, such that a part of the second curved portion 339*b* may have an opened '⊔' shape.

Meanwhile, each of the first to fourth feed lines 332, 334, 336, and 338 may include a bridge line 331*a* defined as a portion which is connected to another feed line formed in the adjacent quadrant of the grounding surface 310, and a general line 331*b* defined as a portion which is not connected to another feed line.

In this case, a thickness of the bridge line 331*a* may be different from a thickness of the general line 331*b*.

That is, in the present exemplary embodiment, the thicknesses of the bridge line 331*a* and the general line 331*b* of each of the first to fourth feed lines 332, 334, 336, and 338 may be different from each other in order to implement impedance matching with electric power to be supplied to the plurality of multi-beam antennas 320. For example, a thickness of the bridge line 331*a* may be greater than a thickness of the general line 331*b*.

The bridge line 331*a* may have a plurality of share lines 331*c* formed between the respective bridge lines 331*a* so as to be connected to another feed line formed in the adjacent quadrant of the grounding surface 310, that is, to another bridge line 331*a*.

In other words, the bridge lines 331*a* may be connected to each other through the plurality of share lines 331*c* formed in a direction intersecting a boundary line of the quadrant.

In this case, a thickness of each of the plurality of share lines 331*c* may be different from a thickness of the bridge line 331*a* and a thickness of the general line 331*b*.

That is, in the present exemplary embodiment, the thicknesses of the bridge line 331*a*, the general line 331*b*, and the plurality of share lines 331*c* of the first to fourth feed lines 332, 334, 336, and 338 may be different from one another in order to implement impedance matching with electric power to be supplied to the plurality of multi-beam antennas 320. For example, a thickness of each of the plurality of share lines 331*c* may be smaller than a thickness of the bridge line 331*a* and a thickness of the general line 331*b*.

The feed circuit 330 supplies electric power to the plurality of multi-beam antennas 320 so that the electromagnetic wave may be radiated in different directions from the plurality of multi-beam antennas 320.

To this end, ends A, B, C, and D of the first to fourth feed lines 332, 334, 336, and 338 of the feed circuit 330 may be curved in a direction perpendicular to the grounding surface 310.

Therefore, the curved portions are correspondingly connected to the plurality of multi-beam antennas 320, respectively, thereby supplying electric power to the plurality of multi-beam antennas 320.

In this case, the feed circuit 330 is supplied with electric power from the plurality of electric power ports 340 formed at points that are in contact with a circumference of the grounding surface 310, and the feed circuit 330 may be selectively supplied with electric power.

Therefore, the feed circuit 330 may selectively supply electric power to at least one of the plurality of multi-beam antennas 320.

For example, as illustrated in FIG. 5, it is assumed that a total of four electric power ports Port1, Port2, Port3, and Port4 are formed at the points that are in contact with the circumferences of the feed circuit 330 and the grounding surface 310 in the x-axis direction of the grounding surface 310.

In this case, with various combinations, electric power may be applied from the total of four electric power ports. That is, electric power may be applied from one of a combination of two electric power ports, a combination of three electric power ports, and a combination of four electric power ports, among the total of four electric power ports.

With the respective combinations, the feed circuit 330 may supply electric power only to the antenna connected to the curved line to which the electric power is applied.

However, in order to balance the directions of the electromagnetic waves radiated from the plurality of multi-beam antennas 320, electric power may be applied from the total of four electric power ports.

Therefore, according to the exemplary embodiment of the present disclosure, the feed circuit 330 is selectively supplied with electric power from the plurality of electric power ports 340 by means of various combinations, and as a result, it is possible to enable the plurality of multi-beam antennas 320 to radiate electromagnetic waves having more improved performance in desired directions.

Figure 6:
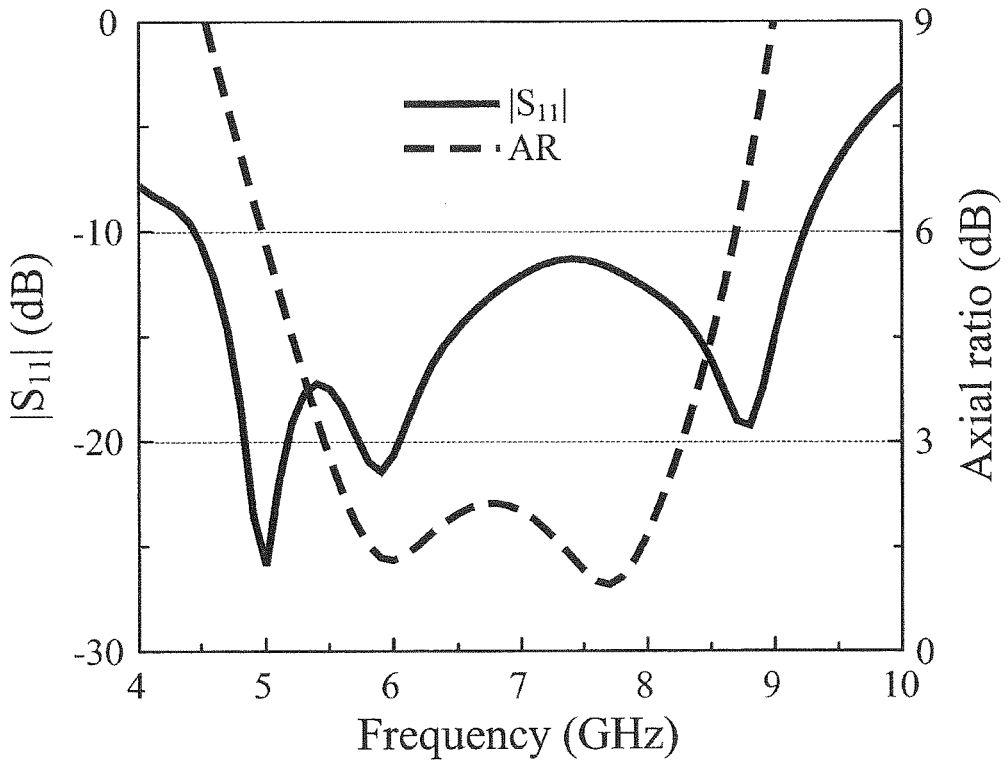
FIG. 6 is a graph illustrating simulated reflection coefficient properties and simulated axial ratio properties of the multi-beam antenna according to the exemplary embodiment of the present disclosure.

FIG. 6 is a graph illustrating simulated reflection coefficient properties and simulated axial ratio properties of the multi-beam antenna according to the exemplary embodiment of the present disclosure.

As illustrated in FIGS. 1 and 6, as a result of the simulation, a simulated bandwidth of a reflection coefficient of the antenna, which is equal to or less than −10 dB, was 69.6% (4.5 to 9.3 GHz), minimum axial ratio values were implemented two times in an axial ratio band equal to or less than 3 dB, and a bandwidth of a reflection coefficient was 42.3% (5.4 to 8.3 GHz).

Accordingly, it can be seen that the multi-beam antenna 100 provides circularly polarized waves corresponding to the broadband.

Figure 7:
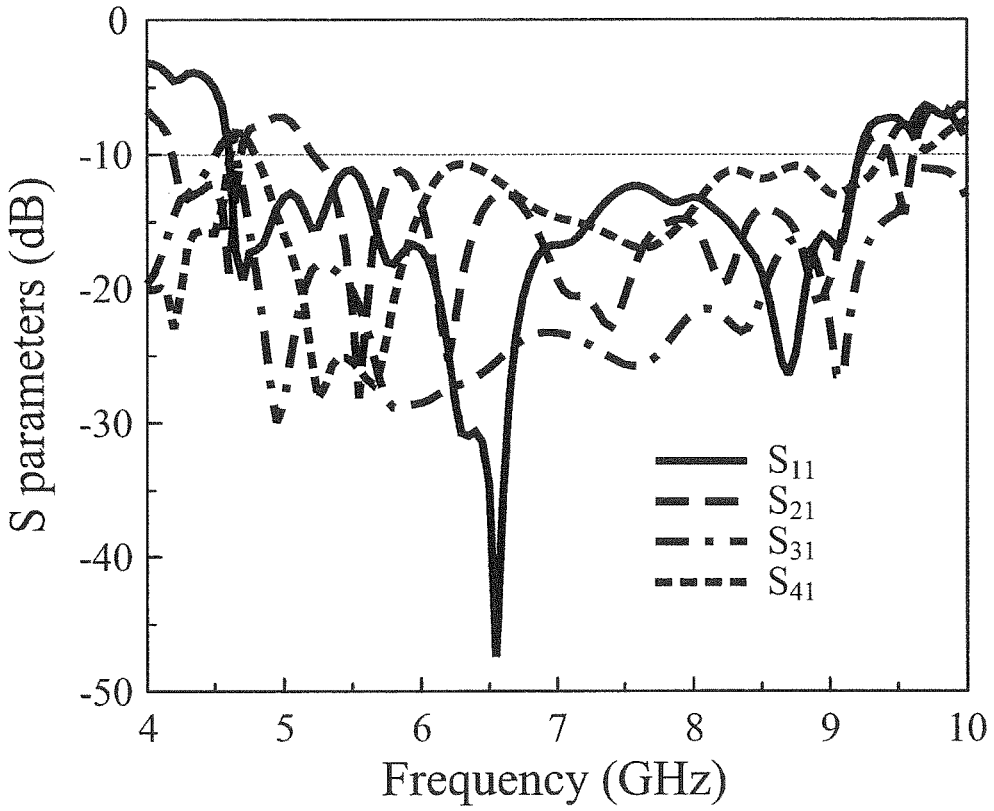
FIGS. 7 and 8 are graphs illustrating simulated and measured reflection coefficient properties of the plurality of multi-beam antennas of the multi-beam antenna array system according to the exemplary embodiment of the present disclosure.
Figure 8:
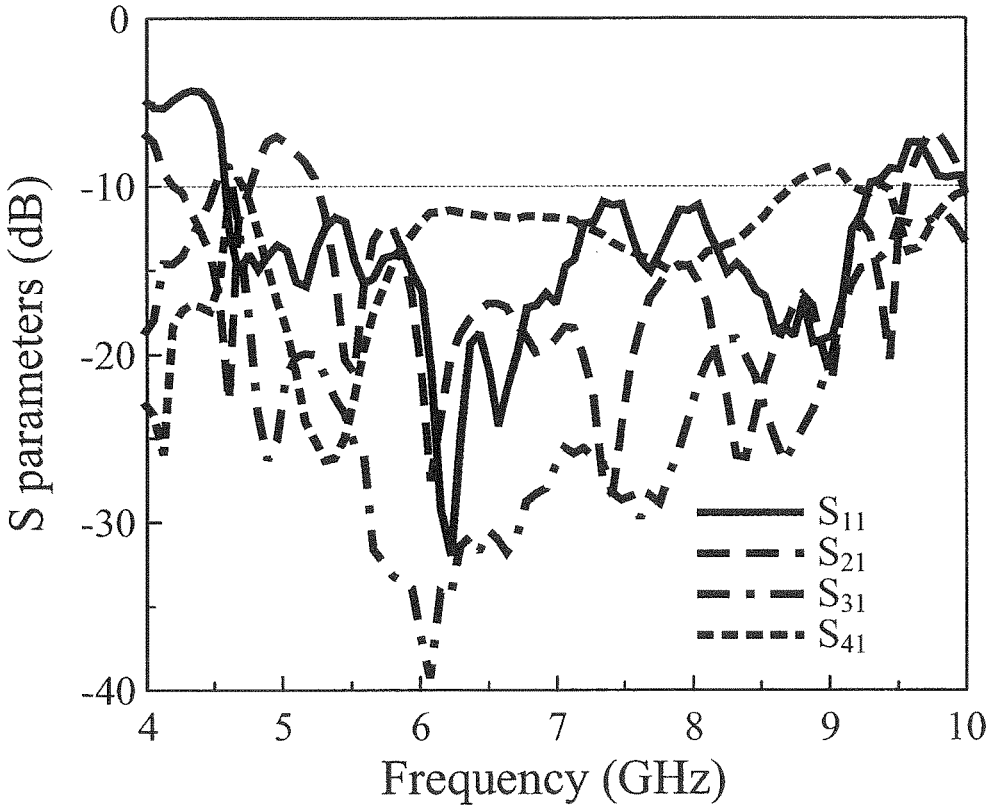

FIGS. 7 and 8 are graphs illustrating simulated and measured reflection coefficient properties of the plurality of multi-beam antennas of the multi-beam antenna array system according to the exemplary embodiment of the present disclosure.

Referring to FIGS. 3, 7, and 8, as a result of the simulation and the measurement, a simulated bandwidth of a reflection coefficient of the antenna, which is equal to or less than −10 dB, was 53.5% at 5.2 to 9 GHz, and a measured bandwidth of a reflection coefficient of the antenna, which is equal to or less than −10 dB, was 48.6% at 5.3 to 8.7 GHz.

Meanwhile, as a result of the simulation, a curved line indicating the simulated reflection coefficient of the antenna is almost identical to a curved line indicating the measured reflection coefficient of the antenna.

Accordingly, it can be seen that the simulated reflection coefficient properties of the antenna and the measured reflection coefficient properties of the antenna are very similar to each other.

Figure 9:
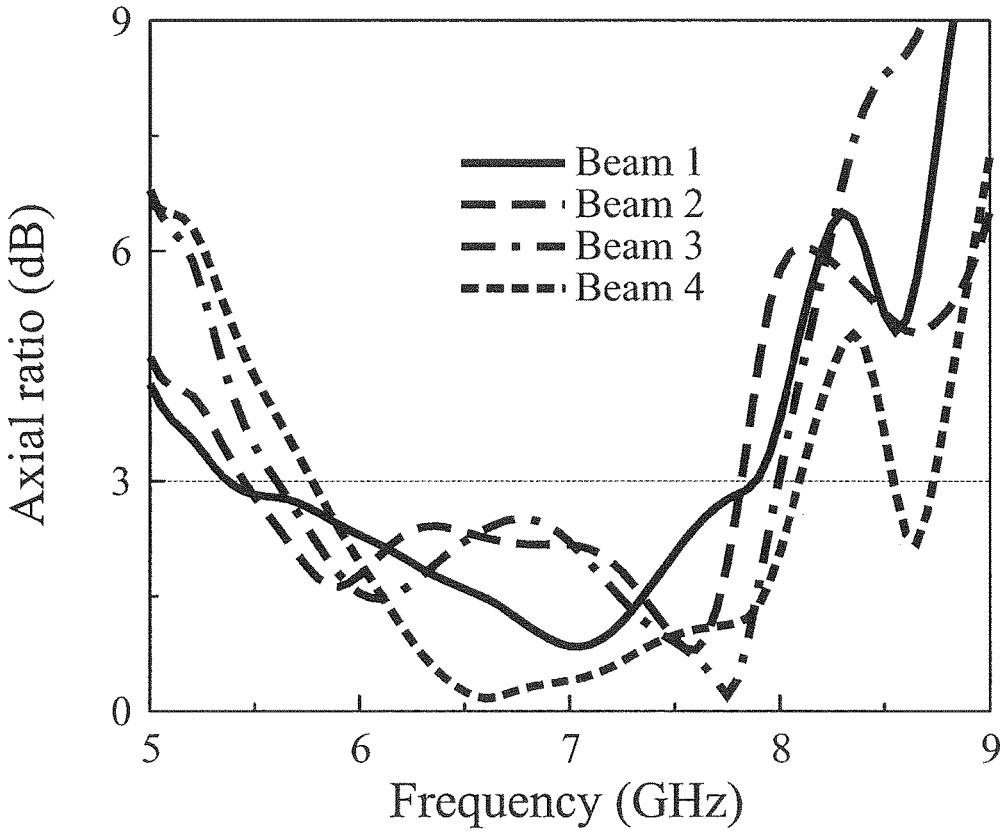
FIG. 9 is a graph illustrating simulated axial ratio properties of the antenna to which electric power is applied through a single port in the multi-beam antenna array system according to the exemplary embodiment of the present disclosure.
Figure 10:
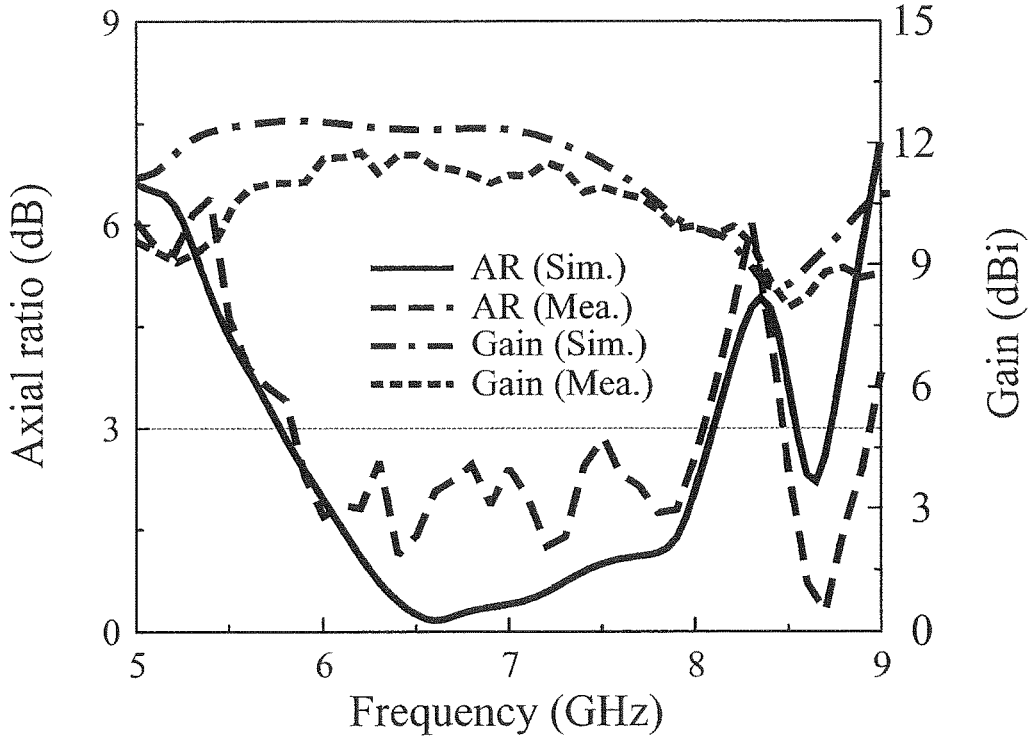
FIGS. 10 and 11 are views illustrating simulated and measured axial ratio properties, simulated and measured gain properties, and radiation patterns of the antenna to which electric power is applied from a fourth electric power port in the multi-beam antenna array system according to the exemplary embodiment of the present disclosure.
Figure 11:
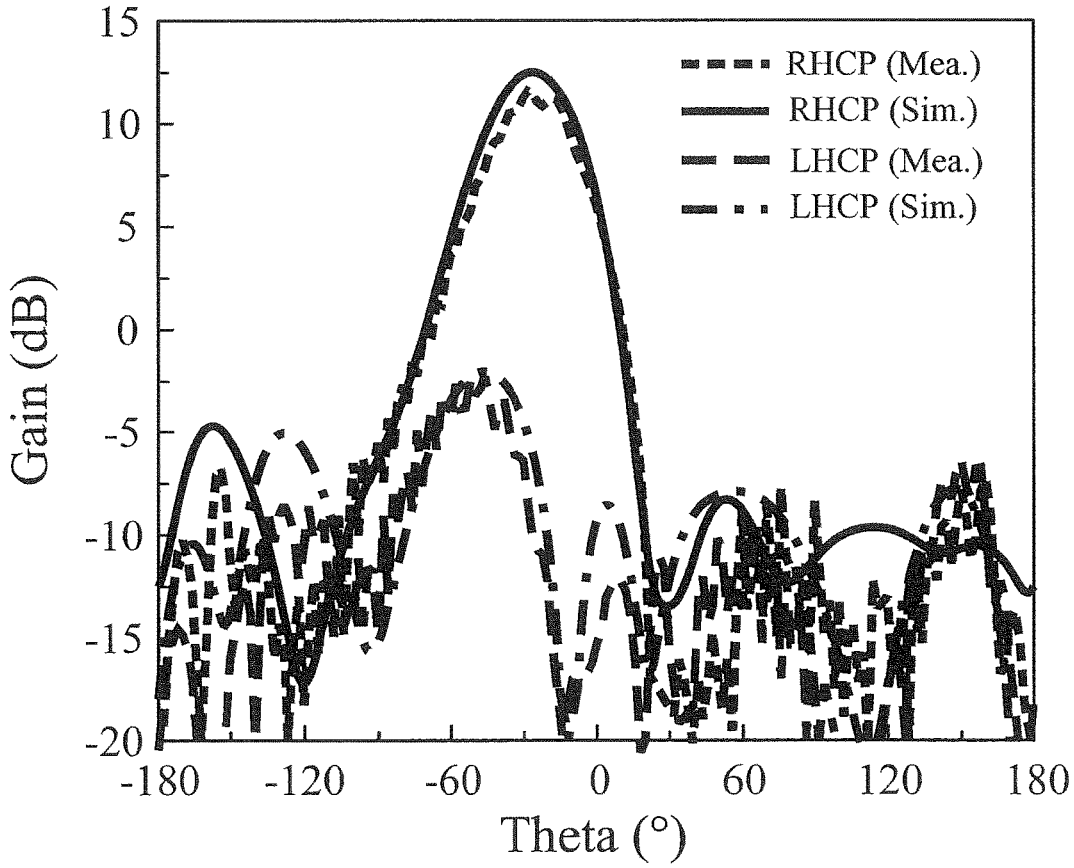

FIG. 9 is a graph illustrating simulated axial ratio properties of the antenna to which electric power is applied through a single port in the multi-beam antenna array system according to the exemplary embodiment of the present disclosure, and FIGS. 10 and 11 are views illustrating simulated and measured axial ratio properties, simulated and measured gain properties, and radiation patterns of the antenna to which electric power is applied from a fourth electric power port in the multi-beam antenna array system according to the exemplary embodiment of the present disclosure.

As illustrated in FIGS. 3 and 9, in the present exemplary embodiment, axial ratio properties of the plurality of multi-beam antennas 320, which are simulated by applying electric power from one of the total of four electric power ports, are compared.

As a result of the simulation, a simulated bandwidth of an axial ratio of the antenna, which is equal to or less than 3 dB, was 34.8% (5.7 to 8.1 GHz) or higher, and four curved lines indicating axial ratio properties in respect to electric power applied from the respective electric power ports were very similar to one another.

As illustrated in FIGS. 3 and 10, in the present exemplary embodiment, in a case in which electric power was applied from the fourth electric power port, axial ratios and gains of the plurality of multi-beam antennas 320 were measured at a point where the x-axis of the grounding surface 310 is 45 degrees and a z-axis is −26 degrees, and the results thereof were compared with simulated axial ratios and simulated gains.

As a result of the measurement, a measured bandwidth of an axial ratio of the antenna, which is equal to or less than 3 dB, was 33.4% (5.75 to 8.05 GHz), and an average gain value was 11.2 dBic in a bandwidth of a reflection coefficient which is equal to or less than −10 dB.

Meanwhile, curved lines indicating the simulated axial ratios and the simulated gains are very similar to curved lines indicating the measured axial ratios and the measured gains.

As illustrated in FIGS. 3 and 11, in the present exemplary embodiment, in a case in which electric power is applied from the fourth electric power port, simulated radiation patterns and measured radiation patterns of the plurality of multi-beam antennas 320 at 6 GHz were compared.

As a result of the measurement, a circularly polarized wave having a maximum gain value of about 11.4 dBic has an angle of about −26 degrees from a center of the arrangement of the antennas. For reference, similar radiation patterns were shown even though electric power is applied from first to third electric power ports in addition to the fourth electric power port.

Meanwhile, as a result of the simulation and the measurement, almost the same gain value and almost the same front-to-back ratio were shown, and the radiation patterns were also similar to each other.

Accordingly, it can be seen that the plurality of multi-beam antennas 320 operates as an antenna having right-hand circular polarization (RHCP) properties.

Figure 12:
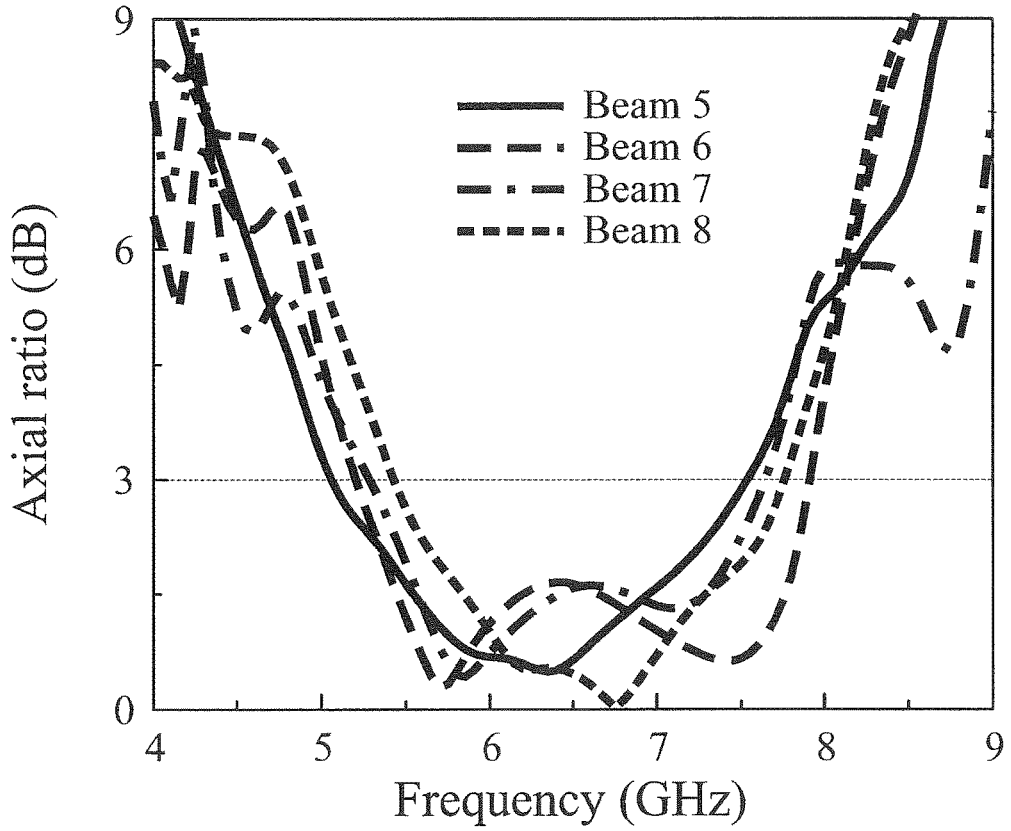
FIG. 12 is a graph illustrating simulated axial ratio properties of the antenna to which electric power is applied through multiple ports in the multi-beam antenna array system according to the exemplary embodiment of the present disclosure.
Figure 13:
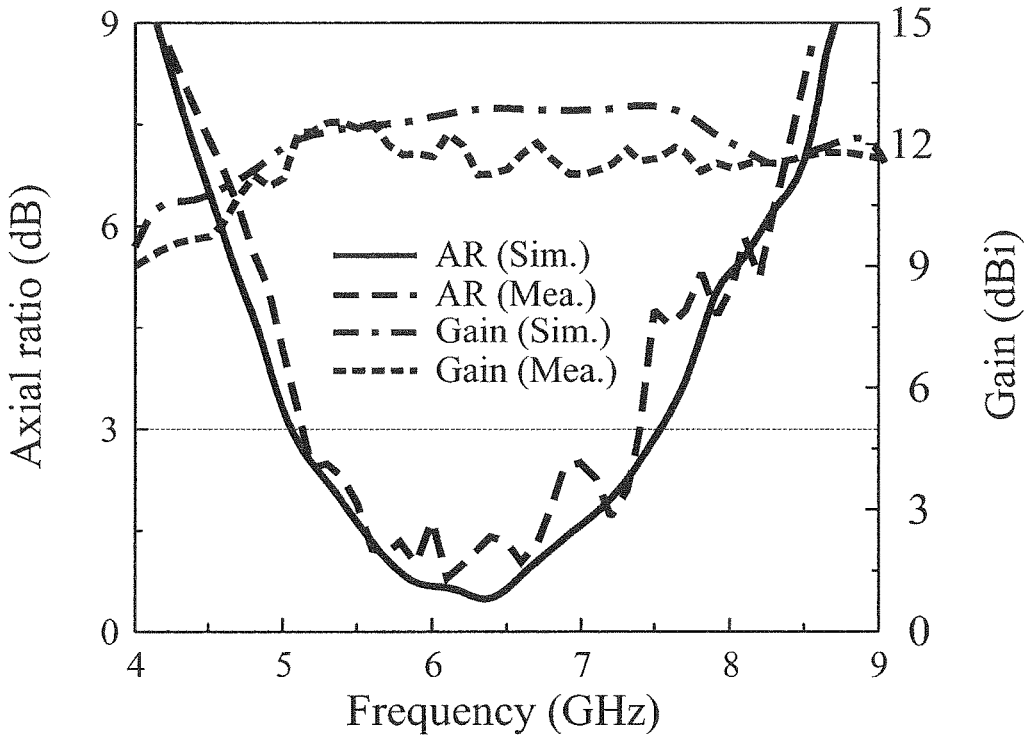
FIGS. 13 and 14 are views illustrating simulated and measured axial ratio properties, simulated and measured gain properties, and radiation patterns of the antenna to which electric power is applied through first and second electric power ports in the multi-beam antenna array system according to the exemplary embodiment of the present disclosure.
Figure 14:
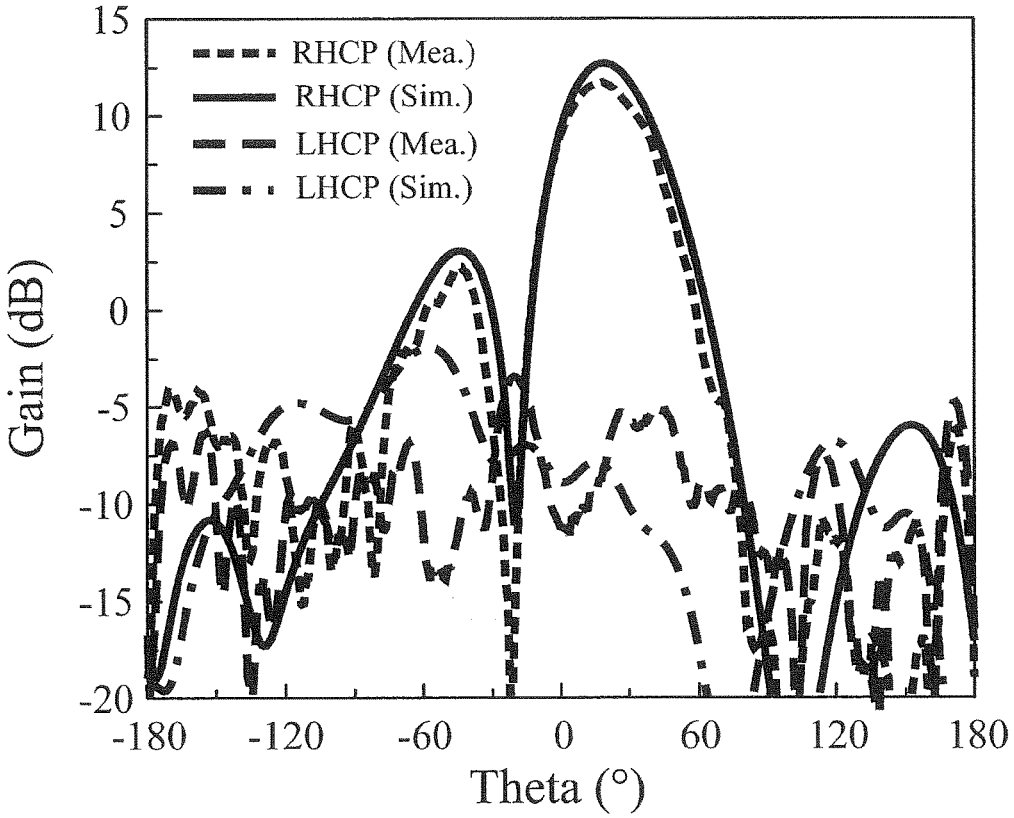

FIG. 12 is a graph illustrating simulated axial ratio properties of the antenna to which electric power is applied through multiple ports in the multi-beam antenna array system according to the exemplary embodiment of the present disclosure, and FIGS. 13 and 14 are views illustrating simulated and measured axial ratio properties, simulated and measured gain properties, and radiation patterns of the antenna to which electric power is applied through the first and second electric power ports in the multi-beam antenna array system according to the exemplary embodiment of the present disclosure.

As illustrated in FIGS. 3 and 12, in the present exemplary embodiment, axial ratio properties of the plurality of multi-beam antennas 320, which are simulated by applying electric power from a combination of two electric power ports among the total of four electric power ports, are compared.

As a result of the simulation, a maximum bandwidth corresponding to 41.2% (5.2 to 7.9 GHz) was shown in a case in which electric power was applied from the first and third electric power ports, and a minimum bandwidth corresponding to 36.4% (5.4 to 7.8 GHz) was shown in a case in which electric power was applied from the third and fourth electric power ports.

Meanwhile, four curved lines indicating axial ratio properties in respect to electric power applied from the respective combinations of the electric power ports were very similar to one another.

As illustrated in FIGS. 3 and 13, in the present exemplary embodiment, in a case in which electric power was applied from the first and second electric power ports, axial ratios and gains of the plurality of multi-beam antennas 320 were measured at a point where the x-axis of the grounding surface 310 is 0 degree and the z-axis is 18 degrees, and the results thereof were compared with simulated axial ratios and simulated gains.

As a result of the measurement, a measured bandwidth of an axial ratio of the antenna, which is equal to or less than 3 dB, was about 37.8% (5.05 to 7.4 GHz), and an average gain value was 11.3 dBic in a bandwidth of a reflection coefficient which is equal to or less than −10 dB.

Meanwhile, curved lines indicating the simulated axial ratios and the simulated gains are very similar to curved lines indicating the measured axial ratios and the measured gains.

As illustrated in FIGS. 3 and 14, in the present exemplary embodiment, in a case in which electric power is applied from the first and second electric power ports, simulated radiation patterns and measured radiation patterns of the plurality of multi-beam antennas 320 at 6 GHz were compared.

As a result of the measurement, a radiation pattern having a maximum gain value was shown at a point where the z-axis of the grounding surface 310 is 18 degrees.

Meanwhile, as a result of the simulation and the measurement, almost the same gain value and almost the same front-to-back ratio were shown, and the radiation patterns were also similar to each other.

Accordingly, it can be seen that the plurality of multi-beam antennas 320 operates as an antenna having right-hand circular polarization (RHCP) properties, and has more improved performance in comparison with the case in which electric power is applied from a single port.

Figure 15:
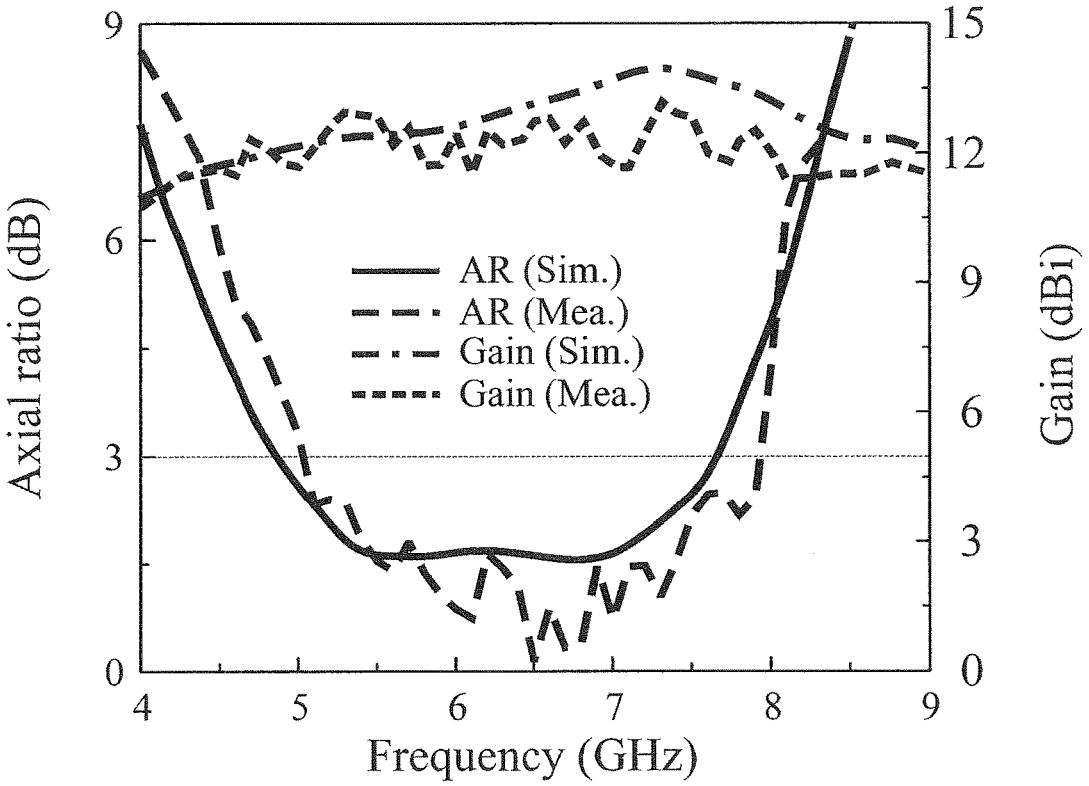
FIGS. 15 and 16 are views illustrating simulated and measured axial ratio properties, simulated and measured gain properties, and radiation patterns of the antenna to which electric power is applied through all of the electric power ports in the multi-beam antenna array system according to the exemplary embodiment of the present disclosure.
Figure 16:
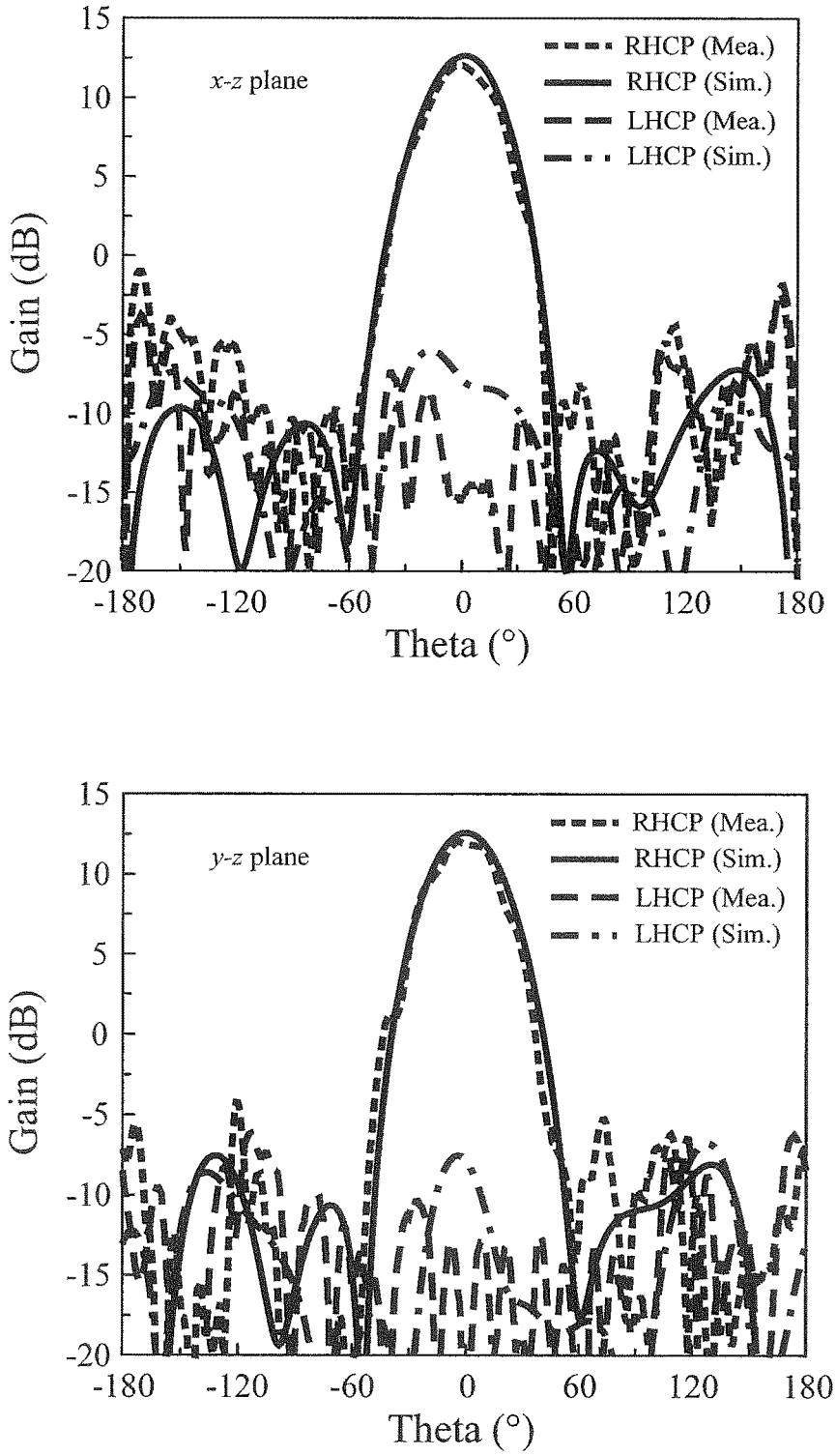

FIGS. 15 and 16 are views illustrating simulated and measured axial ratio properties, simulated and measured gain properties, and radiation patterns of the antenna to which electric power is applied through all of the electric power ports in the multi-beam antenna array system according to the exemplary embodiment of the present disclosure.

Referring to FIGS. 3 and 15, in the present exemplary embodiment, axial ratios and gains of the plurality of multi-beam antennas 320 were measured at a point where both of the x-axis and the z-axis of the grounding surface 310 are 0 degree, and the results thereof were compared with simulated axial ratios and simulated gains.

As a result of the measurement, a measured bandwidth of an axial ratio of the antenna, which is equal to or less than 3 dB, was about 46.2% (5 to 8 GHz), and an average gain value was 11.6 dBic.

Meanwhile, curved lines indicating the simulated axial ratios and the simulated gains are very similar to curved lines indicating the measured axial ratios and the measured gains.

As illustrated in FIGS. 3 and 16, in the present exemplary embodiment, in a case in which electric power is applied from all of the electric power ports, simulated radiation patterns and measured radiation patterns of the plurality of multi-beam antennas 320 at 6 GHz were compared.

For reference, a graph illustrated at the upper side in FIG. 16 illustrates the comparison between the radiation patterns in an X-Z plane, and a graph illustrated at the lower side in FIG. 16 illustrates the comparison between the radiation patterns in an Y-Z plane.

As a result of the simulation and the measurement, high gains were shown in the respective planes, almost the same gain value and almost the same front-to-back ratio were shown, and the radiation patterns were also similar to each other.

In addition, a direction of a circularly polarized wave having a maximum gain value did not deviate in a broadside direction, and as a result, interference was minimized.

Accordingly, it can be seen that the plurality of multi-beam antennas 320 operates as an antenna having right-hand circular polarization (RHCP) properties, and has more improved performance in comparison with the case in which electric power is applied from the multiple ports and electric power is applied from a particular combination of the electric power ports.

While the specific exemplary embodiments according to the present disclosure have been described above, the exemplary embodiments may be modified to various exemplary embodiments without departing from the scope of the present disclosure. Therefore, the scope of the present disclosure should not be limited to the described exemplary embodiments, and should be defined by not only the claims to be described below, but also those equivalent to the claims.

While the present disclosure has been described with reference to the limited exemplary embodiments and the drawings, the present disclosure is not limited to the exemplary embodiments, and may be variously modified and altered from the disclosure by those skilled in the art to which the present disclosure pertains. Therefore, the spirit of the present disclosure should be defined by the appended claims, and all of the equivalents or equivalent modifications of the claims belong to the scope of the spirit of the present disclosure.

What is claimed is:

1. A multi-beam antenna comprising:

a dielectric substrate; and a radiating part which includes a first radiating element and a second radiating element formed on the dielectric substrate so as to radiate electromagnetic waves, wherein the first radiating element includes a first upper radiating member which is formed on an upper portion of the dielectric substrate at one side based on a first direction of the dielectric substrate, and a first lower radiating member which is formed on a lower portion of the dielectric substrate at the other side based on the first direction of the dielectric substrate, and the second radiating element includes a second upper radiating member which is formed on the upper portion of the dielectric substrate at one side based on a second direction of the dielectric substrate, and a second lower radiating member which is formed on the lower portion of the dielectric substrate at the other side based on the second direction of the dielectric substrate, the multi-beam antenna further comprising:

a connecting part which includes a semi-ring-shaped first connecting portion that connects the first upper radiating member and the second upper radiating member, and a semi-ring-shaped second connecting portion that connects the first lower radiating member and the second lower radiating member.

2. The multi-beam antenna according to claim 1, wherein the electromagnetic wave is a linearly polarized wave or a circularly polarized wave.

3. The multi-beam antenna according to claim 1, further comprising:

a plurality of parasitic elements which is disposed on the upper portion of the dielectric substrate between the first radiating element and the second radiating element so as to expand a bandwidth of the electromagnetic wave.

4. The multi-beam antenna according to claim 3, wherein the plurality of parasitic elements is disposed to be spaced apart from the first radiating element and the second radiating element.

5. The multi-beam antenna according to claim 3, wherein the plurality of parasitic elements has a structure in which the parasitic elements, which face each other, are symmetrical to each other based on an intersection point where the first radiating element and the second radiating element are orthogonal to each other.

6. The multi-beam antenna according to claim 1, further comprising:

a power supply line which is connected to a lower portion of the radiating part and supplies electric power to the radiating part.

* * * * *